US012049743B2

(12) United States Patent
Griesemer et al.

(10) Patent No.: US 12,049,743 B2
(45) Date of Patent: Jul. 30, 2024

(54) SLURRY WALL CUTTER

(71) Applicant: Liebherr-Werk Nenzing GmbH, Nenzing (AT)

(72) Inventors: Tobias Griesemer, Nueziders (AT); Sebastian Wedl, Feldkirch (AT); Maria Knuenz, Sulz (AT); Adrian Fend, Koblach (AT)

(73) Assignee: LIEBHERR-WERK NENZING GMBH, Nenzing (AT)

( * ) Notice: Subject to any disclaimer, the term of this patent is extended or adjusted under 35 U.S.C. 154(b) by 511 days.

(21) Appl. No.: 16/748,713

(22) Filed: Jan. 21, 2020

(65) Prior Publication Data

US 2020/0232182 A1 Jul. 23, 2020

(30) Foreign Application Priority Data

Jan. 21, 2019 (DE) ..... 20 2019 100 319.7

(51) Int. Cl.
*E02F 3/12* (2006.01)
*E02F 3/24* (2006.01)
(Continued)

(52) U.S. Cl.
CPC ..... *E02F 5/08* (2013.01); *E02F 3/246* (2013.01); *E02F 5/14* (2013.01)

(58) Field of Classification Search
CPC ..... E02F 5/08; E02F 3/246; E02F 5/14; E02F 3/205; E02F 3/3681; E02F 3/475;
(Continued)

(56) References Cited

U.S. PATENT DOCUMENTS 1,814,094 A * 7/1931 Rhodes ..... E02F 5/08 37/190
1,850,363 A * 3/1932 Vaughn ..... E02F 5/14 37/355

(Continued)

FOREIGN PATENT DOCUMENTS

| | | | |
|---|---|---|---|
| CN | 1190043 | A | 8/1998 |
| CN | 106495057 | A | 3/2017 |
| EP | 1666671 | A1 | 6/2006 |

OTHER PUBLICATIONS

China National Intellectual Property Administration, Office Action and Search Report Issued in Application No. 202010068435.5, May 16, 2022, 22 pages. (Submitted with Machine Translation).

*Primary Examiner* — Edwin J Toledo-Duran
(74) *Attorney, Agent, or Firm* — McCoy Russell LLP

(57) ABSTRACT

The invention relates to a slurry wall cutter for producing vertical ground trenches, which can be connected to a carrier apparatus, comprising a frame, a motor unit and a drive unit which is releasably connectable with the frame, wherein the drive unit comprises a carrier structure, at least one gear mechanism arranged on the carrier structure as well as a cutting tool for crushing ground material, which connected to the gear mechanism and drivable by the motor unit, wherein the motor unit is releasably connectable to the drive unit and wherein the frame and the drive unit respectively comprise guide means which are configured in such a way that the drive unit can be pushed laterally into and out of the frame.

10 Claims, 3 Drawing Sheets

(51) Int. Cl.
*E02F 5/08* (2006.01)
*E02F 5/14* (2006.01)

(58) Field of Classification Search
CPC ..... E02F 5/02; E02F 5/145; E02F 9/2292; E02D 17/13; E02D 3/12; E02D 5/00
See application file for complete search history.

(56) References Cited

U.S. PATENT DOCUMENTS 3,524,270 A * 8/1970 Reising ..... E02F 9/2866 37/189
4,172,616 A * 10/1979 Delli-Gatti, Jr. ..... E21C 25/10 175/106
4,694,915 A * 9/1987 Bauer ..... E21B 4/16 175/96
4,718,504 A * 1/1988 Terashima ..... E21B 7/001 175/102
4,834,197 A * 5/1989 Bauer ..... E02F 3/205 299/85.2
4,843,742 A * 7/1989 Camelleri ..... E02F 3/086 37/360
4,883,134 A * 11/1989 Bollinger ..... E02F 3/205 37/189
5,192,115 A * 3/1993 Hartman ..... E21D 9/1026 198/522
5,267,902 A * 12/1993 Arzberger ..... E02D 17/13 464/89
5,964,305 A * 10/1999 Arzberger ..... F16D 3/185 175/91
5,975,644 A * 11/1999 Lang ..... E02F 3/246 37/302
6,076,290 A * 6/2000 Seitle ..... E02F 3/475 37/348
6,193,444 B1 * 2/2001 Jonninen ..... E02F 3/205 299/79.1
6,626,500 B1 * 9/2003 Cribb ..... E02F 3/205 299/41.1
7,363,734 B2 * 4/2008 Arzberger ..... E02F 3/205 384/93
7,604,301 B1 * 10/2009 Lang ..... E02F 3/205 299/68
8,632,275 B2 * 1/2014 Chagnot ..... E02D 7/16 173/39
9,004,609 B2 * 4/2015 Hartwig ..... E21C 27/24 299/76
9,212,552 B2 * 12/2015 Hartwig ..... E21C 29/02
10,570,583 B2 * 2/2020 Wu ..... E02F 9/0866
10,767,338 B2 * 9/2020 Azzolin ..... E21C 27/24
10,889,955 B2 * 1/2021 Niermann ..... E02F 3/3636
11,041,282 B2 * 6/2021 Laghi ..... E02F 3/26
11,788,249 B2 * 10/2023 Niermann ..... E02D 37/00 405/230
2004/0234345 A1 * 11/2004 Arzberger ..... E02D 17/13 405/266
2006/0037218 A1 * 2/2006 Stoetzer ..... E02F 3/205 37/352
2009/0165338 A1 * 7/2009 Chagnot ..... E02F 3/205 37/189
2011/0247246 A1 * 10/2011 Ertmer ..... E02F 3/10 37/403
2012/0308306 A1 * 12/2012 Kruse ..... B09C 1/00 405/128.75
2013/0075156 A1 * 3/2013 Casadei ..... G06F 15/00 702/9
2018/0142439 A1 * 5/2018 Azzolin ..... E02F 3/205
2019/0106855 A1 * 4/2019 Laghi ..... E02D 17/13
2019/0323205 A1 * 10/2019 Bernasinski ..... E02F 3/246
2020/0002916 A1 * 1/2020 Coupland ..... E02F 3/205
2021/0381191 A1 * 12/2021 Stengl ..... E02D 13/04

* cited by examiner

SLURRY WALL CUTTER

CROSS REFERENCE TO RELATED APPLICATION

The present application claims priority to German Patent Application No 20 2019 100 319.7 filed on Jan. 21, 2019. The entire contents of the above-listed application are hereby incorporated by reference for all purposes.

TECHNICAL FIELD

The present invention relates to a slurry wall cutter according to the preamble of claim 1, as well as to a slurry wall cutter according to the preamble of claim 10.

BACKGROUND AND SUMMARY

Slurry wall cutters are known in various variants from the prior art. Various driving methods can be used for the cutting tools of such slurry wall cutters, which are used for crushing the ground material when producing the ground trench. One or multiple motors for the rotationally driving of multiple cutter wheels via corresponding gear mechanisms are often used.

Usually two cutter wheels per drive unit are installed in slurry wall cutters. Accordingly, at least two gear mechanisms assigned to the respective cutting wheels per slurry wall cutter or per drive unit are used. These gear mechanisms and other components such as wear plates mounted to the drive unit are subject to the usual cutting wear, and must therefore be maintained or replaced at regular intervals. Therefore, not only the initial mounting of the drive unit is a relevant working step, but also the repeated necessary mounting/demounting for maintenance purposes or worn components.

In the mounting/demounting process, usually the entire drive unit is mounted or demounted to provide access to the gear mechanisms. This exchange process usually is very complex and time-consuming.

Against this background, the object underlying the present invention is to provide a slurry wall cutter having a drive unit which can be mounted and demounted in a simple and fast manner.

According to the invention, this object is achieved by a slurry wall cutter having the features of claim 1, and by a slurry wall cutter having the features of claim 10.

Accordingly, the invention on the one hand relates to a slurry wall cutter for producing vertical ground trenches, which can be connected to a carrier machine, including a frame, a motor unit and a drive unit which is releasably connectable to the frame. The drive unit includes a carrier structure, at least one gear mechanism arranged on the carrier structure as well as a cutting tool for crushing ground material which is connected to the gear mechanism and drivable by the motor unit. According to the invention, the motor unit is releasably connectable to the drive unit, wherein the frame and the drive unit respectively comprise guide means which are configured in such a way that the drive unit, with respect to a longitudinal axis of the frame, can be laterally pushed into and out of the frame, in particular if the connection with the motor unit is released.

The lateral sliding in and out of the drive unit which is disconnected from the motor unit provides significant advantages when performing maintenance works, and allows replacing components in few steps. The motor unit, which is not subject to wear to the same extent as the gear mechanism, can remain in the installed position in or on the frame, during mounting and or maintenance works, while merely the drive unit has to be demounted and mounted again, respectively. During mounting/demounting, in particular the mounting time is therefore significantly shorter than with conventional slurry wall cutters. Owing to the simplified mounting and demounting process, safety on the workplace is likewise increased. Potentially occurring errors in the replacement process are minimized owing to the small scope and simple configuration of the overall process.

Advantageous embodiments of the invention result from the dependent claims and the following description.

In one embodiment, it is provided that the drive unit comprises a motor receptacle, to which the motor unit can releasably connected and which is optionally arranged on the top side of the carrier structure. For demounting the drive unit, merely the connection between motor unit and motor receptacle and the connection between drive unit and frame have to be released, so that the drive unit can be displaced laterally with respect to the frame of the slurry wall cutter, while the motor unit remains in the installed position. The motor receptacle can comprise mechanical connections or connections for hydraulic and/or electric lines. These can be configured as quick-release coupling or multi coupling.

Multiple motor units and therefore multiple motor receptacles can be provided. Furthermore, the slurry wall cutter can include multiple drive units with in each case one associated motor unit.

In another embodiment, it is provided that the frame comprises a cutout at at least one side, optionally at two opposite sides, through which the motor receptacle can be pushed-through when the drive unit is displaced in a manner guidable by means of the guide means. The motor receptacle, in the mounted state, thus protrudes into the frame of the slurry wall cutter and can be displaced relative to the frame and pushed through the cutout(s) after the disconnection from the motor unit. In other words, the cutout has geometric dimensions exceeding those of the motor receptacle.

In another embodiment, it is provided that the guide means of the frame and of the drive unit are configured as beveled edges, the chamfered surfaces of which contact each other in the connected state. When the drive unit is displaced laterally relative to the frame, the chambered surfaces thus slide past one another. Here, there may be a clearance perpendicular to the slide-in/slide-out direction. For example, a downward clearance (in a vertical orientation of the frame) can be present, so that the drive unit has to be pushed towards the frame for a contacting guidance by means of the guide means.

The guide means optionally are formed on the frame and on the carrier structure. In particular, the motor receptacle can be arranged between the guide means on the upper side of the carrier structure.

In another embodiment, it is provided that the frame has a recess on the lower side, into which a part, optionally an upper part of the drive unit can be introduced, wherein a releasable connection of drive unit and frame, viewed relative to the frame, can either be produced via lateral introduction of the drive unit into the lateral cutout or (in vertical orientation of the frame) introduction of the drive unit into the lower recess from top to bottom.

In this way, initial mounting of the drive unit or mounting after replacement or maintenance of the motor unit, optionally with the motor unit connected to the motor receptacle, can take place from bottom to top by insertion into the lower recess, viewed relative to the frame. Therefore, the recess is configured in such a way that the motor receptacle can be inserted together with the motor unit connected to it.

Mounting/demounting of the drive unit for the purpose of mounting or maintenance of the wear parts, such as gear mechanism and wear plates, can, by contrast, be effected by lateral displacement of the drive unit with respect to the frame.

In another embodiment, it is provided that the guide means are arranged and configured in such a way that a centering and fine-positioning of the drive unit relative to the frame is effected when introducing the drive unit into the lower recess of the frame. The guide means therefore fulfil a double function. Optionally, they are configured as beveled edges, wherein the chamfered surfaces of beveled edges formed on the frame are directed downwards, so that a centering takes place automatically by way of the contacting and guiding of the respective chamfered surfaces during the introduction of the drive unit from bottom to top. This significantly simplifies and speeds up the installation process.

In another embodiment, it is provided that the drive unit can be introduced into the lower recess in a state where the motor unit is connected to the motor receptacle.

In another embodiment, it is provided that the drive unit is connectable with the lower end of the frame in a releasable manner.

In another embodiment, it is provided that the motor unit is releasably connectable with the frame or with the respective connections provided on the frame, wherein the connections can be used to produce a hydraulic and/or electric supply of the motor unit.

The present invention further relates to a slurry wall cutter for producing vertical trenches in the ground, which cutter can be connected to a carrier apparatus, including a frame, a motor unit and a drive unit, wherein the drive unit comprises a carrier structure, at least one gear mechanism arranged on the carrier structure and at least one cutting tool which is connected with the gear mechanism and which is drivable by the motor unit for crushing ground material, and wherein the frame and the drive unit comprise connecting means, by means of which the frame and the drive unit can be connected to one another in a releasable manner. According to the invention, the motor unit can be connected releasably with the drive unit, wherein the connecting means are accessible from outside, so that establishing or releasing of the connection between drive unit and frame can be performed from outside.

Mounting and demounting of the drive unit to the frame is significantly simplified owing to the connecting means easily accessible from the outside, which connection means optionally are screw-nut-connections. This results in enormous time savings and increased safety at the workplace, compared to other embodiments, in which connecting elements have to be released or attached within the frame during the mounting and demounting processes.

In one embodiment, it is provided that the frame comprises indentations which allow access to the connecting means from outside, wherein the frame is optionally configured in such a way that the parts of the connecting means accessible from the outside are arranged within the indentations and within the outer contour of the frame extending beyond the indentation.

By providing indentations, which in particular are arranged laterally, the parts of the connecting means which are accessible for establishing or releasing the connection, in particular the nuts and screw heads of the screw connections, do not produce beyond the outer contour of the frame that would be achieved without indentations, so that the space requirements or the outer dimensions of the slurry wall cutter do not increase. The indentations are optionally arranged on those sides of the frame where no cutouts are located.

The present invention further relates to a slurry wall cutter for producing vertical trenches in the ground, which cutter can be connected to a carrier apparatus, including a frame, a motor unit and a drive unit, wherein the drive unit includes a carrier structure, at least one gear mechanism arranged on the carrier structure as well as at least one cutting tool for crushing ground material which is connected to the gear mechanism and which is drivable by the motor unit, wherein the frame and the drive unit respectively comprise connecting means by means of which frame and drive unit can be connected reliably with one another, wherein the connection means are accessible from outside, so that establishing or releasing the connection between drive unit and frame can be performed from outside, and wherein the frame and the drive unit comprise guide means which are configured such that the drive unit can be pushed laterally into the frame and be removed therefrom if the connection between drive unit and motor unit is released.

Advantages and features of the two slurry wall cutters described above are combined, so that specific advantages and features and the possible further embodiments do not have to be discussed in greater detail again.

Further features, details and advantages of the invention result from the exemplary embodiment explained in the following with reference to the Figures. The Figures show in:

DETAILED DESCRIPTION

Figure 1:
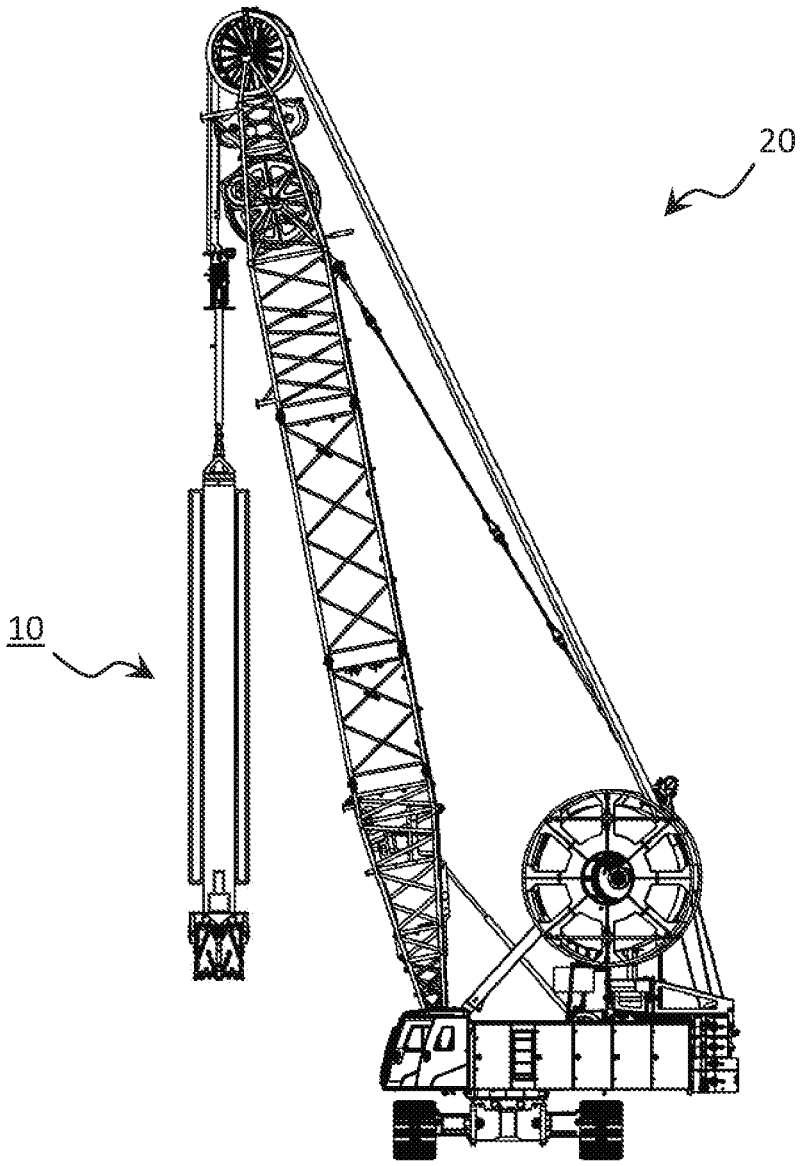
FIG. 1: a carrier apparatus with a slurry wall cutter in a lateral view.

FIG. 1 shows a carrier apparatus 20, configured as a mobile cable excavator, with a slurry wall cutter 10 according to the invention, in a side view. Of course, other work machines such as hydraulic excavators or special civil engineering machines can be used as the carrier apparatus 20 for the slurry wall cutter according to the invention.

Figure 2:
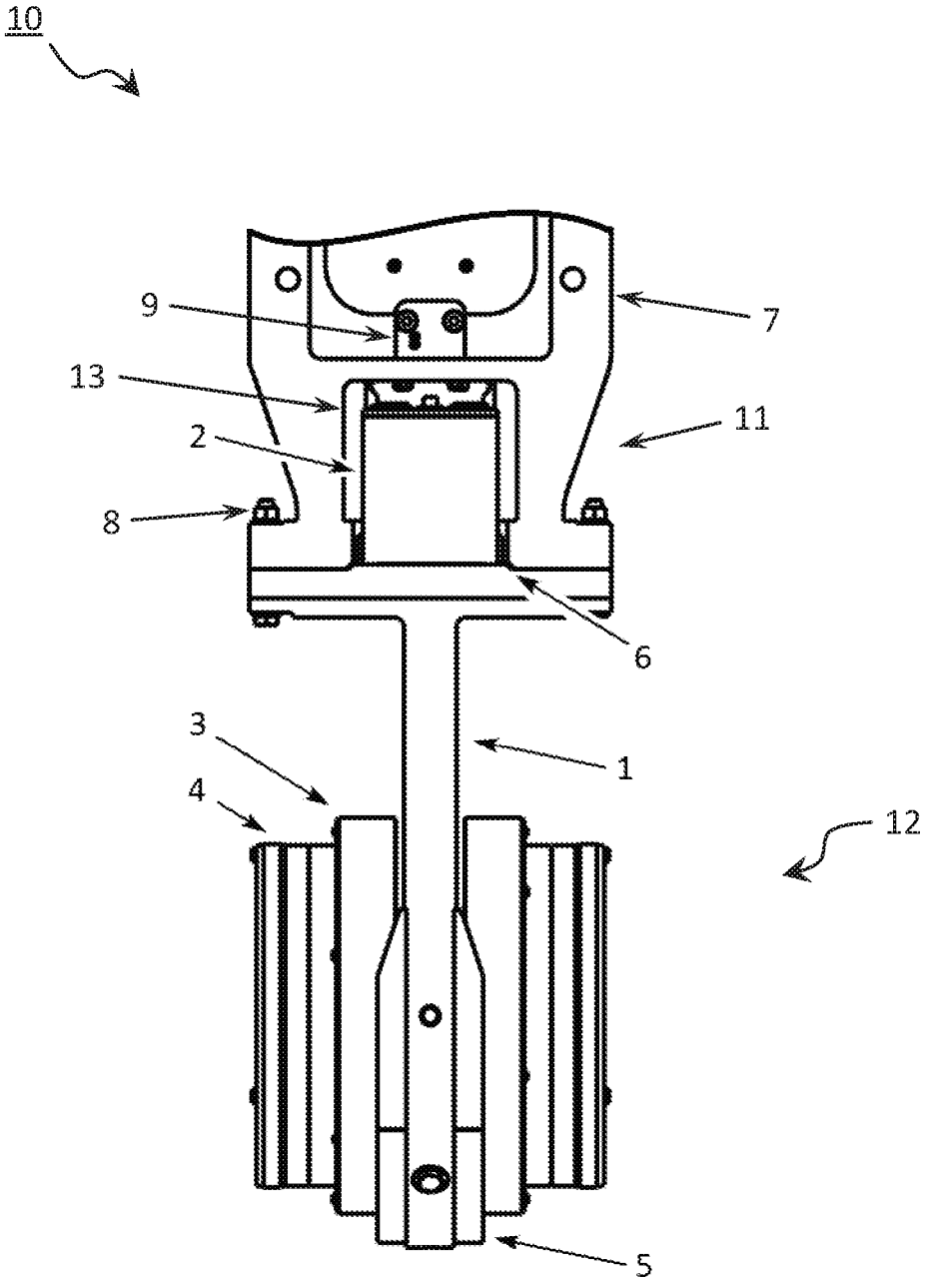
FIG. 2: an exemplary embodiment of the slurry wall cutter in the mounted state in a lateral view.

FIG. 2 illustrates a detail of an exemplary embodiment of the slurry wall cutter 10 according to the invention in a side view, which illustrates the drive unit 12 and the lower end of the frame 7. The slurry wall cutter 10 includes a frame 7, with the lower end of which the drive unit 12 is releasably connected.

The drive unit 12 includes a carrier structure 1, which has a carrying function for the further components of the drive unit 12, such as the cutting tools (not shown). Multiple gear mechanisms 3 are located in the lower region of the carrier structure 1, to which receptacles 4 for the cutting tools configured as cutting wheels are connected. The carrier structure 1, in a lateral view, has a substantially T-shaped cross-section, wherein gear mechanisms 3 are arranged at the same height to both sides of the longitudinal beam of the T-shaped cross-section. The carrier structure 1 comprise wear plates 5 on the face sides (viewed from the side).

The gear mechanisms 3 and the wear plates 5 constitute components of the drive unit 12 that are particular prone to wear and therefore are high-maintenance that need to be replaced at regular intervals. Conventionally, the entire drive unit 12 including the motor unit(s) 9 connected thereto have to be demounted and the respective components have to be exchanged or serviced to that end. The present invention significantly speeds up and simplifies this replacement or mounting/demounting process.

The drive unit 12 is reversibly connected to the lower side of the frame 7 of the slurry wall cutter 10 at the upper side of the drive unit (via the crossbar of the T-shaped cross-section, viewed from the side). The connecting means 8 form a screw-nut-connection, wherein the upper side of the carrier structure 1 and the lower region of the frame 7 comprise corresponding openings for the screws 8.

The slurry wall cutter 10 according to the invention can be fastened or suspended on a carrier apparatus 20 via the frame 7. The slurry wall cutter 10 further comprises at least one motor unit 9 by means of which the cutting wheels are drivable via the gear mechanisms 3. The energy supply of the motor unit(s) 9 is ensured via corresponding supply lines in or on the frame 7. The motor unit 9 can include or constitute a hydraulic or electric motor.

The connection of the motor unit 9 to the drive unit 12 occurs via a motor receptacle 2 arranged on the upper side of the drive unit 12, to which the motor unit 9 can be connected in a releasable manner. To that end, respective ports for mechanical, electrical, hydraulic and/or other connections are provided, which can be configured as quick-release couplings or multi-coupling, for example. The connection of motor unit 9 with the connections of the frame 7 is likewise releasable and can also be configured as a quick-release coupling or multi-coupling.

The motor receptacle 2 protrudes into the frame 7, so that in the mounted state, the motor unit 9 is arranged within the frame 7. For this purpose, the frame 7 comprises a recess at its lower side, into which the motor receptacle 2, optionally together with the motor unit 9 already connected with the motor receptacle 2, can be introduced when mounting the drive unit 12.

The upper side of the carrier structure 1 comprises guide means 6 configured as beveled edges which correspond with respective guide means 6 on the lower side of the frame 7 at the edge of the recess that are likewise configured as beveled edges. The chamfered surfaces of the beveled edges 6 of the frame 7 are directed downwards, wherein the chamfered surfaces of the beveled edges 6 of the drive unit 12 and of the frame 7 contact each other in the mounted state. When introducing the drive unit 12 into the lower recess, the beveled edges 6 function as auxiliary means which center the drive unit 12 during insertion on the last portion. Mounting of the drive unit 12 via the lower recess is simplified thereby.

The drive unit 12 including the motor unit 9 can be mounted on the frame 7 via the lower recess.

The frame 7 further comprises another cutout 13 laterally, the geometrical dimensions of which exceed those of the motor unit 9 (in a view from the side). The cutout 13 is open downwards and thus forms a contiguous opening with the lower recess. The beveled edges 6 (with the slurry wall cutter 10 in vertical orientation) are oriented horizontally and parallelly to one another and are located at opposite edges of the lower recess. The beveled edges 6 thus serve as guide means, via which the drive unit 12 can be displaced laterally-horizontally with respect to the frame 7 (with the slurry wall cutter 10 in vertical orientation). To that end, the connection via the connecting means 8 has to be released, of course.

The drive unit 12 can therefore be pushed laterally out of the frame 7 or pushed into said frame without the motor unit 9 after release of the connection between motor receptacle 2 and motor unit 9. The guidance along the guide means 6 facilitates the displacing process. This results in a simplified and faster mounting and demounting process of the drive unit 12, with the motor unit 9 remaining within the frame 7. This is particularly advantageous in cases where the drive unit 12 is to be demounted and mounted again for the purpose of replacement or maintenance of the components which are prone to wear, such as gear mechanism 3, cutter wheel receptacles 4 or wear plates 5.

The guide means 6 consequently fulfill a double function. On the one hand, they serve for centering the drive unit 12 during the mounting process from bottom to top (with the frame 7 in vertical orientation) via the lower recess (in which the motor unit 9 may already be connected with the motor receptacle 2), and on the other hand they serve for the guiding of the drive unit 12 during the lateral insertion and removal via the lateral cutout 13 (with the motor unit 9 not being connected to the motor receptacle 2 in this case).

The frame 7 can have such a cutout 13 at both sides, so that the lateral insertion and removal is possible via both sides. It can furthermore be provided that the geometrical dimensions of the lateral cutout exceed those of the motor receptacle 2 and of the motor unit 9 in the connected state, so that the drive unit 12 can be laterally mounted/demounted together with the motor unit 9.

The drive unit 12 can either extent over the entire or substantially the entire width of the frame 7, so that only one single drive unit 12 is used in the slurry wall cutter according to the invention. Alternatively, multiple, in particular two drive units 12 next to one another can be used, which are each assigned to respectively one motor unit 9. In this case, one lower recess for one drive unit 12 is respectively located on the lower side of the frame 7. Furthermore, the frame 7 expediently comprises a cutout 13 on both sides in this case, so that each of the drive units 12 can be pushed into the frame 7 on the respective side.

The frame 7 further comprises indentations 11 in the lower region of the front and rear sides (which are located to the right and to the left of the cutout 13 in FIG. 2), inside of which the parts accessible from outside (in particular the nuts) of the connection means 8 are located in the connected state. This way, the screw-nut-connection between the drive unit 12 and the frame 7 can easily be released or fixed from outside, without additional connecting elements inside the frame 7 being required, which would complicate the mounting and demounting process. The nuts 8 are furthermore located completely within the indentations 11, that is within the outer contour of the frame 7, which would be achieved if the outer contour was extended beyond the indentations 11, that is the contour that would result without indentations 11. This results in space savings, and a collision of the connecting means 8 with the walls of the ground trench to be produced by means of the slurry wall cutter is prevented.

Figure 3:
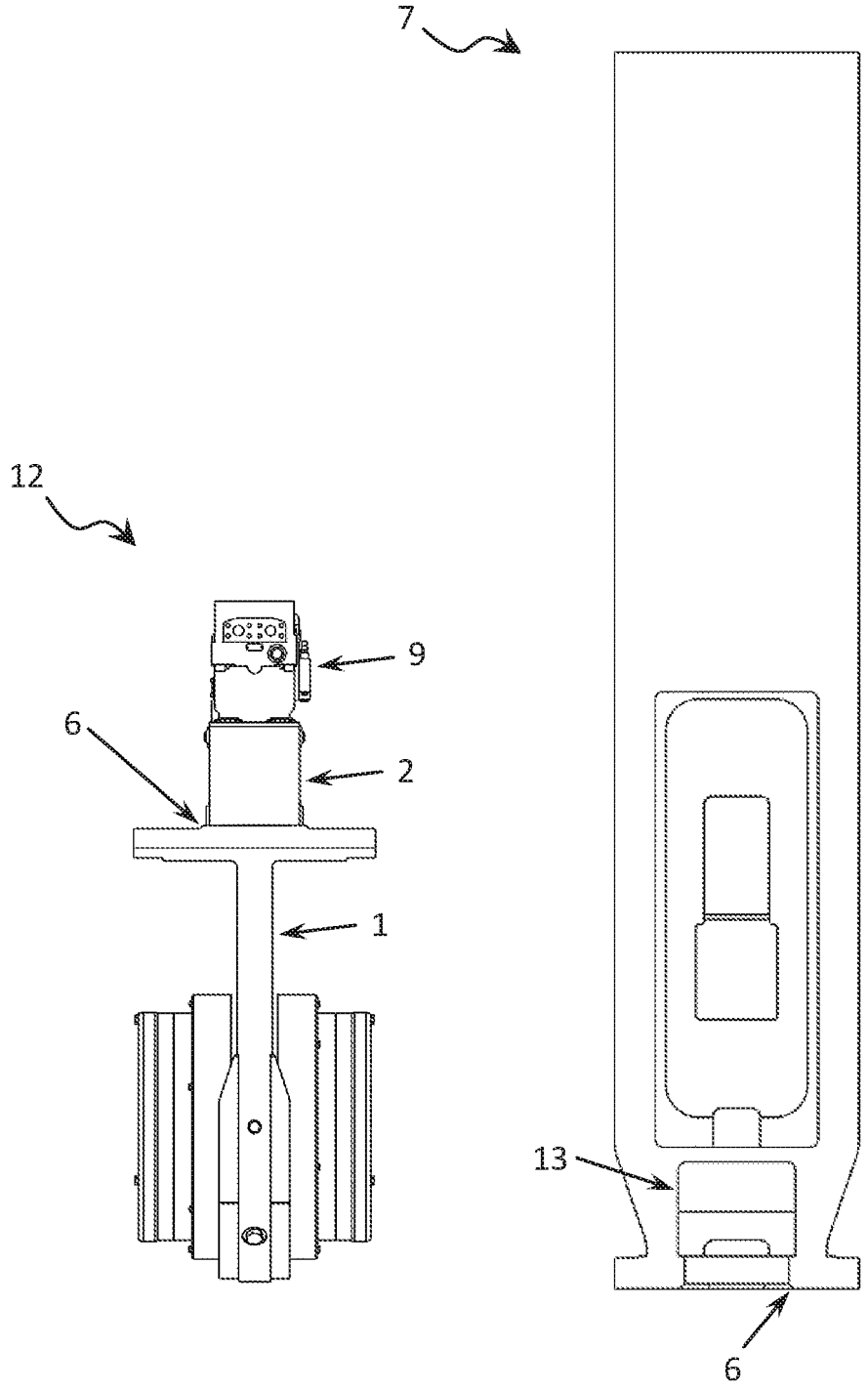
FIG. 3: the exemplary embodiment of the slurry wall cutter according to FIG. 2 in a demounted state.

FIG. 3 shows the slurry wall cutter in a state where the drive unit 12 is demounted from the frame 7, with the motor unit 9 being connected with the motor receptacle 2. With respect to the (vertically oriented) frame 7, such a demounting occurs from top to bottom via the lower recess of the frame 7. In this illustration, the beveled edges 6 of the frame 7 and of the carrier structure 1 are discernable individually.

The Figures are drawn to scale although other relative dimensions may be used if desired.

LIST OF REFERENCE CHARACTERS

1 carrier structure
2 motor receptacle
3 gear mechanism
4 cutter wheel receptacle
5 wear plate
6 guide means
7 frame
8 connecting means
9 motor unit
10 slurry wall cutter
11 indentation
12 drive unit
13 cutout
20 carrier apparatus

The invention claimed is:

1. A slurry wall cutter for producing vertical trenches in the ground, which is connectable to a carrier apparatus, the slurry wall cutter comprising:

a frame;

a motor unit; and a drive unit releasably connectable with the frame, the drive unit comprising: a carrier structure, at least one gear mechanism arranged on the carrier structure, and at least one cutting tool for crushing ground material, the at least one cutting tool connected to the at least one gear mechanism and drivable by the motor unit;

wherein the motor unit is positioned within a recess of the frame and releasably connectable to a top side of the carrier structure, wherein the top side of the carrier structure is opposite the at least one cutting tool, wherein the carrier structure is connected to the frame via connecting means, wherein the connecting means are accessible from an exterior of the slurry wall cutter when in an assembled state, and wherein the top side of the carrier structure on either side of the motor unit is substantially covered by the frame when in the assembled state, wherein the frame and the drive unit respectively comprise guide means, which are configured such that the drive unit moves laterally along the guide means into and out of the frame, and the top side of the carrier structure and a lower side of the frame are in contact with each other when in the assembled state, wherein an outer surface of the frame includes a portion that flares away from a center of the slurry wall cutter, and wherein the portion of the outer surface that flares away from the center of the slurry wall cutter includes the lower side of the frame that is in contact with the top side of the carrier structure, and wherein a motor receptacle is accessible from the exterior of the slurry wall cutter via a cutout when in the assembled state, the cutout formed into the frame.

2. The slurry wall cutter according to claim 1, wherein the drive unit comprises the motor receptacle, and the motor unit is releasably connectable to a top side of the motor receptacle and a bottom side of the motor receptacle arranged on the top side of the carrier structure.

3. The slurry wall cutter according to claim 2, wherein the frame comprises the cutout at a side through which the motor receptacle is received when the drive unit is displaced via the guide means.

4. The slurry wall cutter according to claim 1, wherein the guide means of the frame and of the drive unit are configured as beveled edges, chamfered surfaces of which contact one another in a connected state.

5. The slurry wall cutter according to claim 1, wherein the frame comprises a recess on a lower side, into which a part is introduceable, wherein a releasable connection of the drive unit and the frame is produceable via lateral introduction of the drive unit into a lateral cutout of the frame or introduction of the drive unit into a lower recess of the frame.

6. The slurry wall cutter according to claim 1, wherein the guide means are arranged and configured to center the drive unit relative to the frame when the drive unit is introduced into a lower recess of the frame.

7. The slurry wall cutter according to claim 6, wherein the motor unit is introduceable into the lower recess of the frame in a state in which the motor unit is connected with the motor receptacle and the motor receptacle is attached to the top side of the carrier structure.

8. The slurry wall cutter according to claim 1, wherein the drive unit is releasably connectable with the lower side of the frame.

9. The slurry wall cutter according to claim 1, wherein the motor unit is releasably connectable with the frame.

10. The slurry wall cutter of claim 1, wherein the connecting means comprise screws.

* * * * *